US009163871B1

(12) United States Patent
Costello

(10) Patent No.: US 9,163,871 B1
(45) Date of Patent: Oct. 20, 2015

(54) COOLER HAVING A BAR EXTENSION

(71) Applicant: Jason Costello, Flagstaff, AZ (US)

(72) Inventor: Jason Costello, Flagstaff, AZ (US)

( * ) Notice: Subject to any disclaimer, the term of this patent is extended or adjusted under 35 U.S.C. 154(b) by 0 days.

(21) Appl. No.: 14/336,947

(22) Filed: Jul. 21, 2014

Related U.S. Application Data

(60) Provisional application No. 61/856,673, filed on Jul. 20, 2013.

(51) Int. Cl.
*F25D 23/02* (2006.01)
*F25D 11/00* (2006.01)

(52) U.S. Cl.
CPC ..... *F25D 23/028* (2013.01); *F25D 11/003* (2013.01)

(58) Field of Classification Search
CPC ..... F25D 23/063; F25D 23/062; F25D 23/06; F25D 3/08; F25D 3/06; F25D 23/028; F25D 23/02; F25D 11/003; F25D 11/00; A45C 11/20; A45C 13/005; E05D 7/125; E05D 7/12; B65D 43/165; B65D 43/164; B65D 43/163; B65D 43/16
USPC ..... 220/592.03, 592.02, 915.2, 915.1, 845, 220/848, 844, 843, 836, 810; 62/457.7, 62/457.1; 16/386
See application file for complete search history.

(56) References Cited

U.S. PATENT DOCUMENTS

| | | | | |
|---|---|---|---|---|
| 2,347,980 | A * | 5/1944 | Apfelbaum | 220/844 |
| 5,967,322 | A * | 10/1999 | Apps et al. | 206/497 |
| 6,315,154 | B1 * | 11/2001 | Newby, Sr. | 220/844 |
| 2006/0255045 | A1 * | 11/2006 | Kim | 220/531 |

FOREIGN PATENT DOCUMENTS

| | | | | |
|---|---|---|---|---|
| FR | 763654 | A * | 5/1934 | B65D 43/165 |

* cited by examiner

*Primary Examiner* — Robert J Hicks
(74) *Attorney, Agent, or Firm* — Invention To Patent Services; Alex Hobson

(57) ABSTRACT

A cooler having at least one bar configured along one side of the cooler lid and/or cooler body is described. A lid and/or body bar is supported by a lid or body support respectively, and has an extended length between the supports wherein a strap or latch may be configured around the bar. For example, a cooler lid may have a lid on the front side of the cooler lid and a cooler body may have a body bar that extends along the front wall of the cooler body. A latch or strap may be configured to pull the lid bar to the body bar, thereby providing for secure sealing of the cooler lid to the cooler body. A strap may be configured around a body bar to positively secure the cooler to an object, such as a vehicle while still allowing for access to the interior of the cooler.

23 Claims, 15 Drawing Sheets

4

COOLER HAVING A BAR EXTENSION

CROSS REFERENCE TO RELATED APPLICATIONS

The present invention claims the benefit of U.S. provisional patent No. 61/856,673, entitled Cooler Having A Bar Extension and filed on Jul. 20, 2013, the entirety of which is incorporated by reference herein.

BACKGROUND OF THE INVENTION

1. Field of the Invention

The present invention relates to coolers and in particular a cooler having at least one bar configured along one side of the cooler lid and/or cooler body.

2. Background

Coolers are typically used to transport food items from one location to another. There have been any number of devices configured to retain a cooler on a vehicle including brackets, cages and the like. However, little has been done to construct a cooler that provides convenient and effective retention means to the vehicle. In some cases, a cooler may be strapped to a bracket and the straps are configured around the cooler. The cooler is susceptible to moving within the straps and sliding out from the straps as it is only retained by the tension and friction of the strap around the cooler. In addition, if an article is desired within the cooler, the straps have to be released to provide access to the cooler interior.

In some instances, coolers need to remain closed and effectively sealed when being transported over rough terrain or water. For example, rafters that are on extended trips need to keep coolers sealed for days before opening them, even while rafting through rapids and being jostled aggressively. The coolers are typically strapped or otherwise retained to beams that run across the raft and the latches provided with the cooler have to be trusted to keep the lid closed and sealed.

There exists a need for a cooler that is constructed with retention means that can allow the cooler to be directly attached to an object, such as a vehicle or raft. In addition, there exists a need for a way to retain a cooler to an object, such as a vehicle, while providing easy access to the interior without detaching the cooler from the object. Finally, there exists a need for a cooler that provides for more secure and effective sealing of the lid to the body and that is easy to manipulate.

SUMMARY OF THE INVENTION

The invention is directed to coolers and in particular a cooler having at least one bar configured along one side of the cooler lid and/or cooler body. A lid and/or body bar is supported by a lid or body support respectively, and has an extended length between the supports wherein a strap or latch may be configured around the bar. For example, a cooler lid may have a lid bar that extends between lid supports on the front side of the cooler lid and a cooler body may have a body bar that extends between body supports on the exterior front wall of the cooler body. A latch or strap may be configured to pull the lid bar to the body bar, thereby providing for secure sealing of the cooler lid to the cooler body. In addition, a strap may be configured around the body bar to positively secure the cooler to an object, such as a vehicle while still allowing for access to the interior of the cooler. In still another embodiment, a cooler body has a body bar extending along the exterior front and exterior back wall. A strap may be configured to extend around the back and front body bars and around an object for retaining the cooler to said object. In this embodiment, the lid may have a lid bar extending along the front side and a latch having a first and second opening for receiving the lid bar and body bar respectively, configured to be clamped down to pull the lid bar to the body bar and effectively seal the cooler. These embodiments provide for positive and secure attachment or retention of a cooler to an object while allowing for access to the cooler.

In an exemplary embodiment, a cooler, as described herein, comprises a lid having a lid bar configured on the front side, wherein a plurality of lid supports having a conduit configured therein supports the lid bar. A lid bar may be configured to extended along the front, back, or sides of the cooler lid, and may extend substantially the entire length, or a portion of the length of the front, back, or lid sides. Substantially the entire length, as used herein, means that the lid bar extends at least 70% of the length of the lid front, back or sides. In an exemplary embodiment, a single lid bar extends along a side of the cooler lid, and in another embodiment, two or more lid bars extend along one of the sides and are retained by three or more lid supports.

A body bar may be configured similarly to the lid bar, wherein a cooler may comprise a single body bar that extends along the exterior front wall of the cooler. Likewise, a body bar may be configured on the exterior of the body front wall, back wall or body side walls, and may extend any suitable length along a body wall. In one embodiment, a body bar extends substantially the entire length of a body wall, or at least about 70% of the length of the body wall. Two or more body bars may extend along a body wall, including the front wall, back wall and body side walls.

A lid and/or body bar may be configured to be inserted into a respective lid or body support, such as being slid through a support conduit and in some cases retained by collars. In another embodiment, a lid and/or body bar may be configured to extend out from the cooler, whereby the bar may be used to support or retain the cooler to an object, or may be used as handles to carry the cooler. A lid bar and/or body bar has an extended length between supports, and an open space around the perimeter of the bar over the extended length. This open space around a lid or body bar allows for a strap or other device, such as a latch to be configured around the bar. A strap that extends around a lid and/or body can be used to positively attach the cooler to an object, wherein the cooler cannot slide out from the strap, as the strap is configured around the bar and retained between supports.

A lid and/or body support may be an integral part of the cooler lid, such as by being permanently attached to the cooler or by being a one-piece unit, wherein the lid support is made as part of the cooler lid, such as through molding. An integral lid and/or body support may be configured through machining as well, wherein a conduit is machined to produce a support. In another embodiment, a lid and/or body support is configured to be detachably attached to the cooler through the use of an fastener.

A lid and/or body bar may be any suitable cross-sectional shape including round or circular, square, polygonal and the like. A preferred cross-sectional shape is round or circular, as this may be more conducive to strapping the cooler down. A lid or body bar having a circular cross-sectional shape may be hollow, such as a cylinder, or solid such as a rod. A lid and/or body bar may have any suitable outer diameter or maximum cross-dimensional dimension including, but not limited to, about 5 mm or more, about 6 mm or more, about 8 mm or more, about 12 mm or more, about 24 mm or more, about 36 mm or more, and any range between and including the values provided. A lid or body bar may be made out of any suitable material including, but not limited to, metal, such as aluminum or stainless steel, plastic, composites and the like.

The cooler lid and cooler body may be made out of any suitable material or materials, including polymers, foam, glass, ceramics, metal and the like. In an exemplary embodiment, a cooler lid and/or cooler body are made by the process of roto-molding. A cooler, as described herein, may comprise a lid with hinges, such as on back side. In another embodiment however, a cooler, as described herein, comprises a lid with no hinges, whereby the lid may be easily removed from the cooler body.

A latch may be configured to couple a lid bar to a body bar and comprise a clamp for urging the two bars toward each other when the clamp is actuated. A latch design to fit at least partially around a lid bar and body bar comprises a first and second opening for receiving said bars. In one embodiment at least one of the opening is a conduit, wherein a bar is completely surrounded by the latch.

The cooler body may comprise a body bar that is retained within the wall of the cooler body, whereby the body bar does not extend out from the planar face of the wall. The body bar may extend along a recess in the cooler body and be secured on either end by the body wall. An open space around the recessed bar may allow for coupling of a latch or extension of a strap there around.

A cooler of the present invention may have any suitable length, width and height, including about 8 inches or more, about 12 inches or more, about 18 inches or more, about 24 inches or more, about 30 inches or more about 36 inches or more, about 48 inches or more, about 60 inches or more and any range between and including the values provided. A cooler may have a length that is approximately 36 inches, a width that is approximately 24 inches and a height that is approximately 24 inches, for example.

A cooler body wall and/or cooler lid may be configured to insulate the interior of the cooler and have a hollow space or porosity between an interior surface an exterior surface of the wall or lid. An insulating material may be configured between the interior and exterior surfaces of the wall panels of the cooler or lid. The thickness of the wall or lid may be any suitable thickness including but not limited to, greater than about 0.25 inches, greater than about 0.375 inches, greater than about 0.5 inches, greater than about 1.0 inch and any range between and including the thickness values provided.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1A:
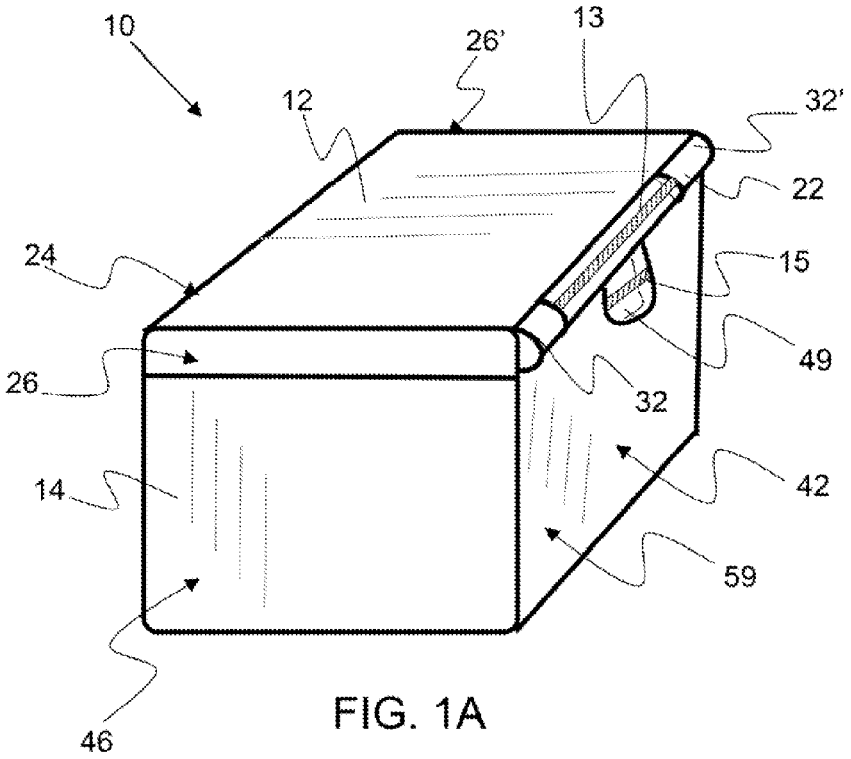

FIG. 1A shows a side isometric view of an exemplary cooler having a lid bar configured between two lid supports.

Figure 1B:
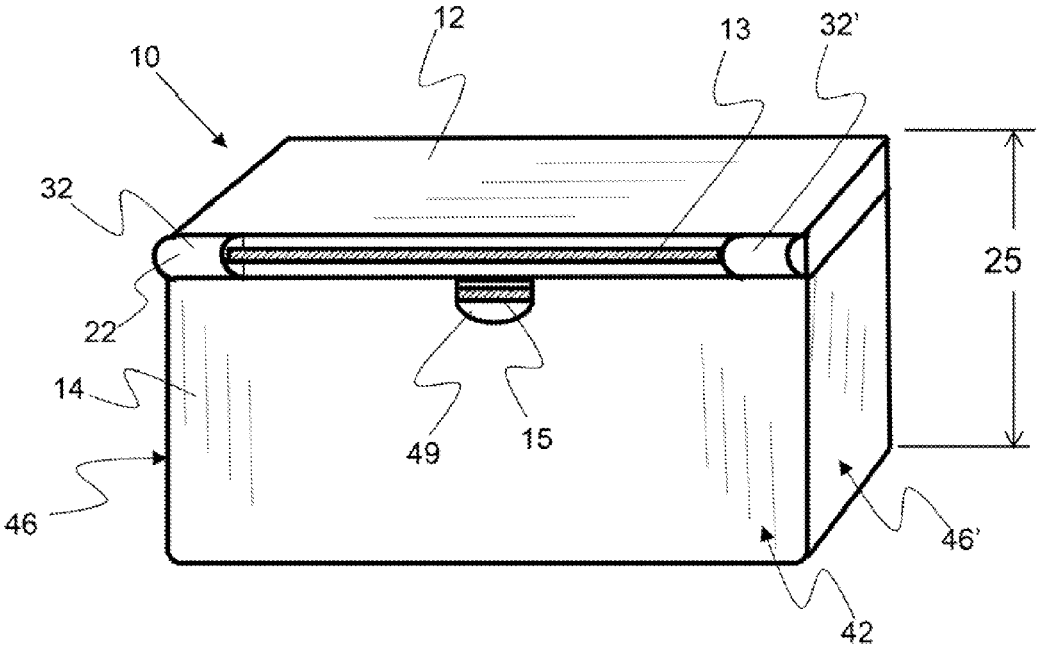

FIG. 1B shows a front isometric view of the cooler shown in FIG. 1A having a body bar in a body wall recess.

Figure 1C:
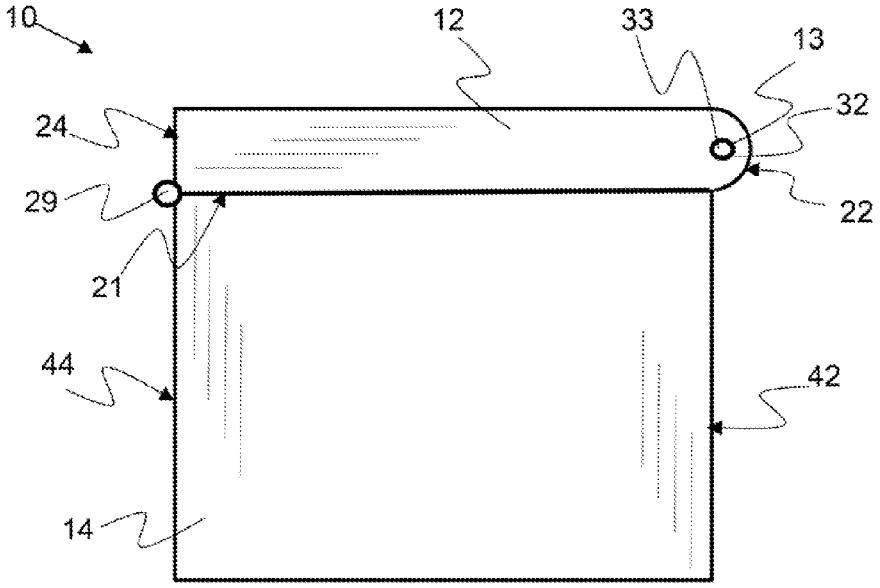

FIG. 1C shows a side view of the cooler shown in FIG. 1A having a lid bar configured on the front side of the lid.

Figure 1D:
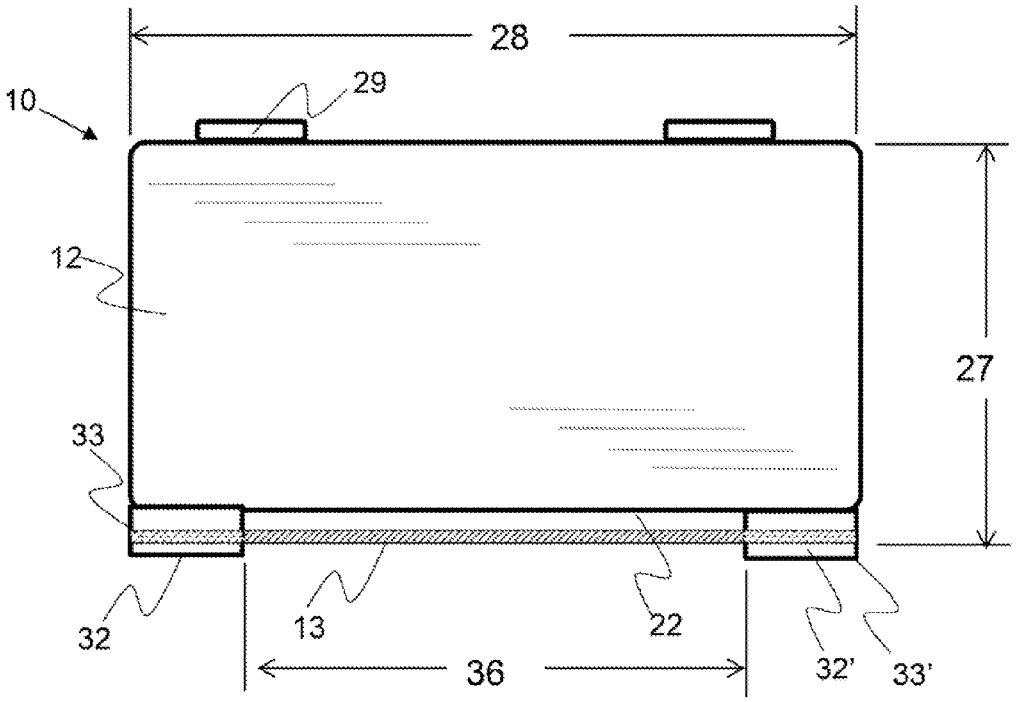

FIG. 1D shows a top-down view of the cooler shown in FIG. 1A having a lid bar extending into conduits with in the lid supports.

Figure 2A:
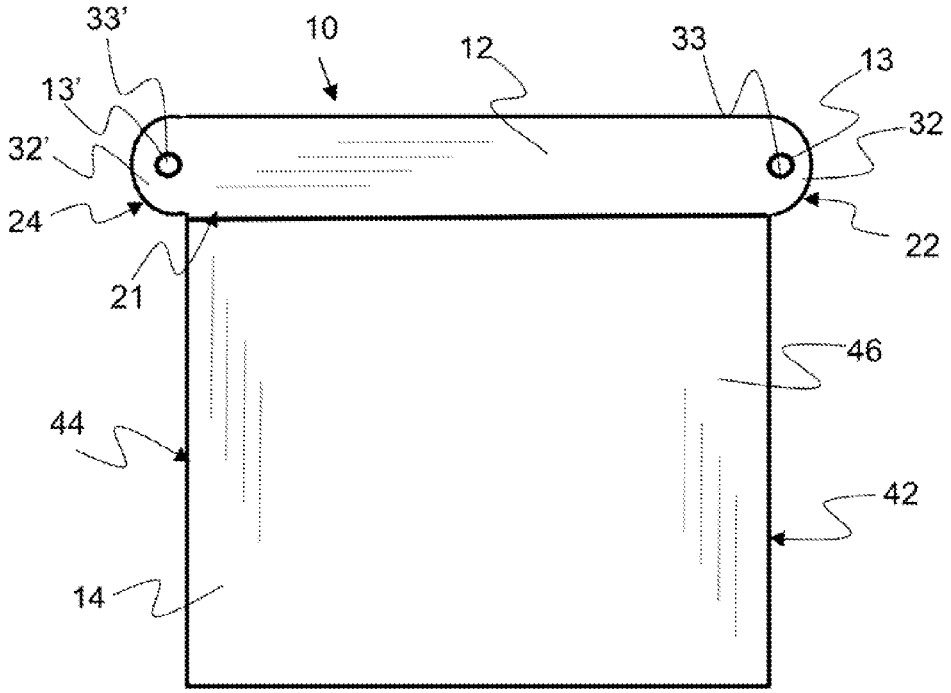

FIG. 2A shows a side view of an exemplary cooler having a lid bar on both the front and back sides.

Figure 2B:
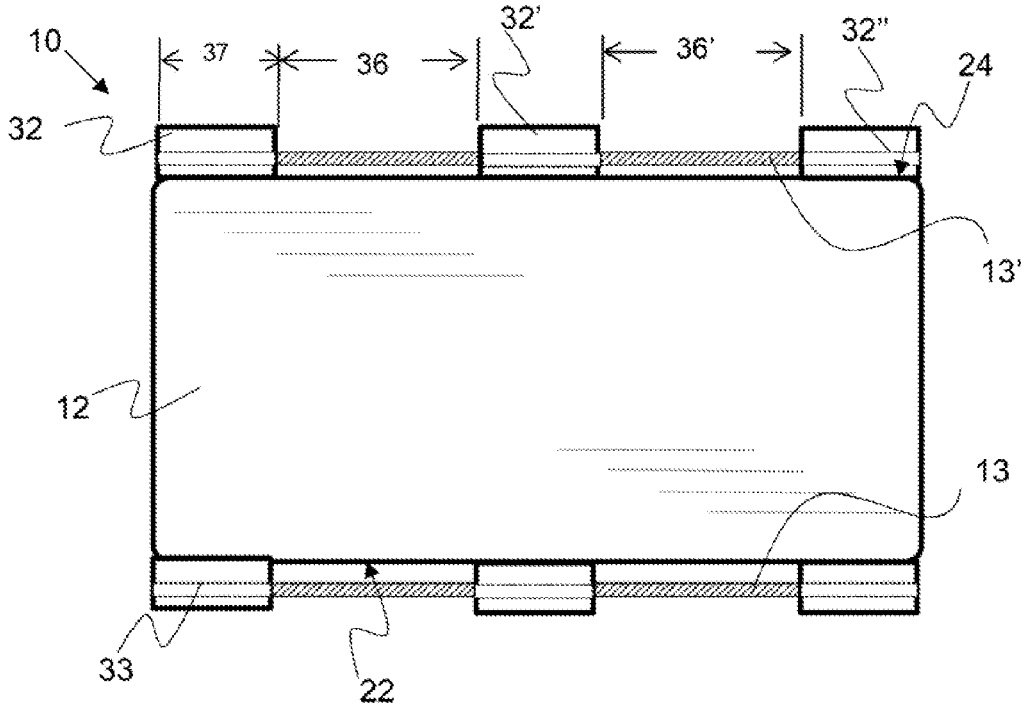

FIG. 2B shows a top-down view of the cooler shown in FIG. 2A having three lid supports for the front and back lid bars.

Figure 3:
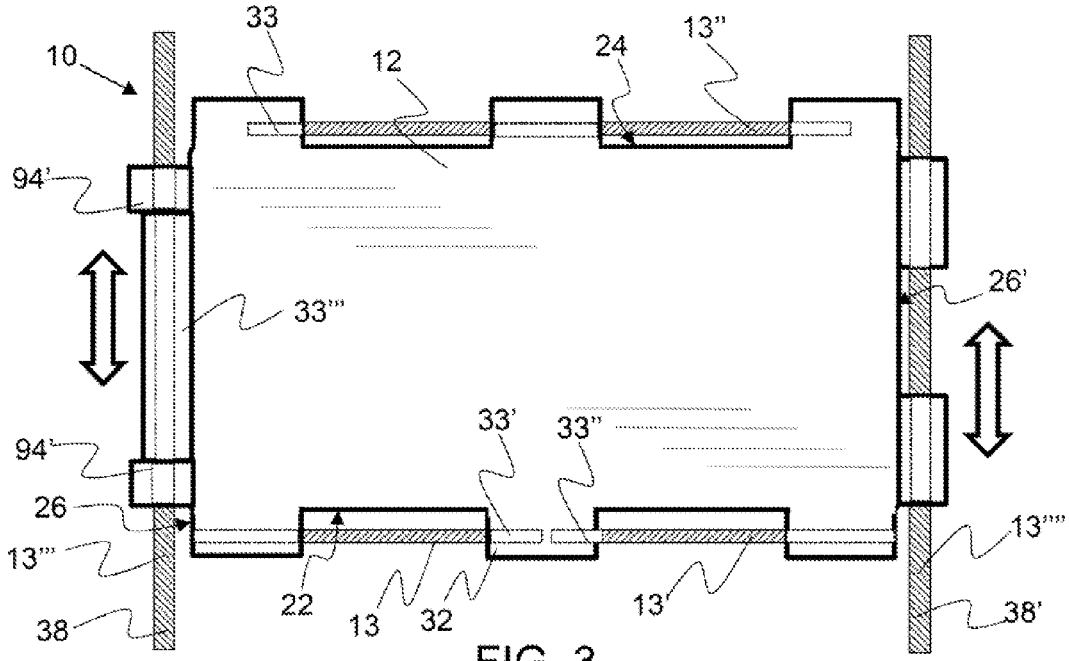

FIG. 3 shows a top-down view of exemplary integral lid supports on both the front and back sides of the lid and lid bars along either lid side.

Figure 4:
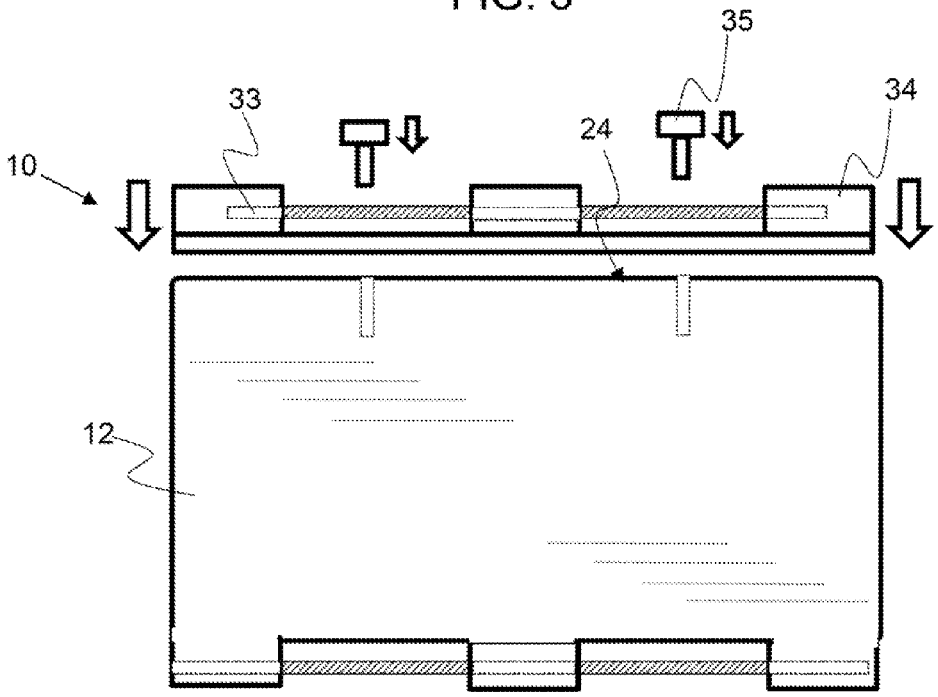

FIG. 4 shows a top-down view of an exemplary cooler having a detachable lid supports on the back side of the cooler lid.

Figure 5A:
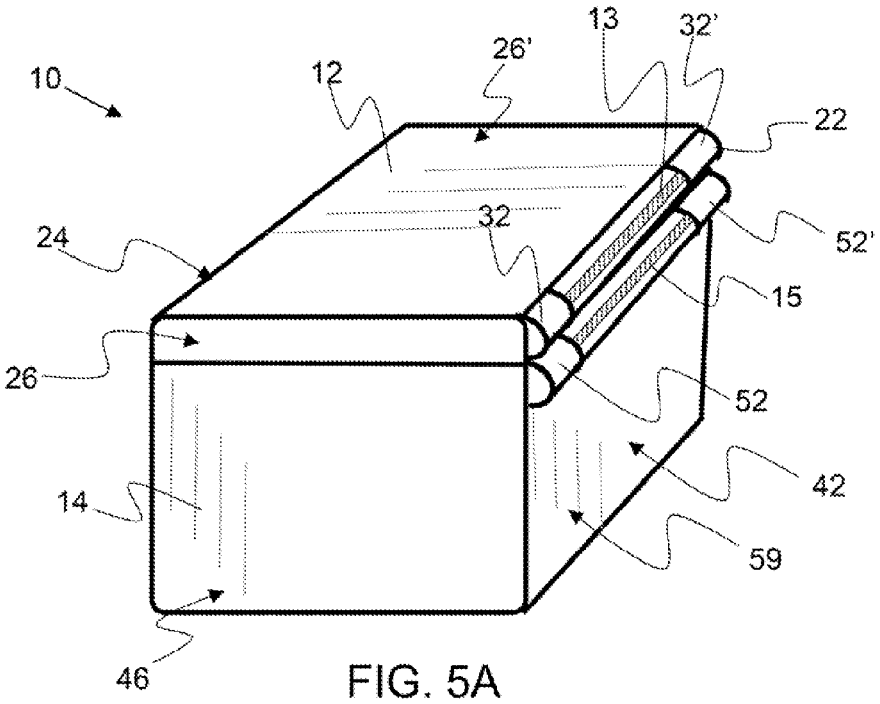

FIG. 5A shows a side isometric view of an exemplary cooler having lid bar and a body bar configured along the front of the cooler.

Figure 5B:
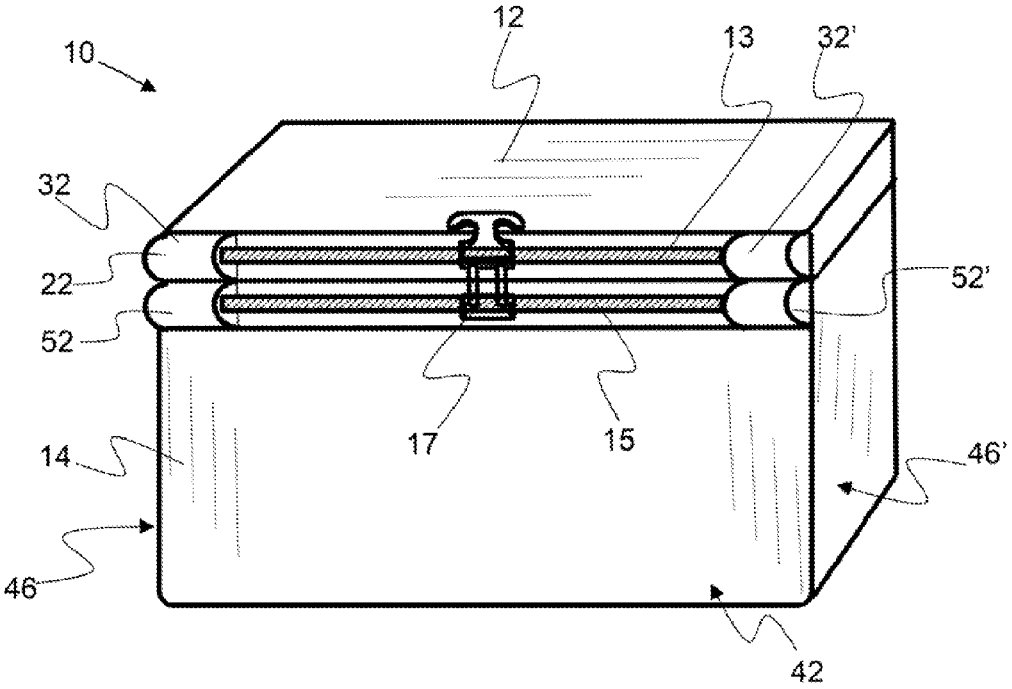

FIG. 5B shows a front isometric view of the cooler shown in FIG. 5A having an exemplary latch configured on the front lid and body bars.

Figure 6:
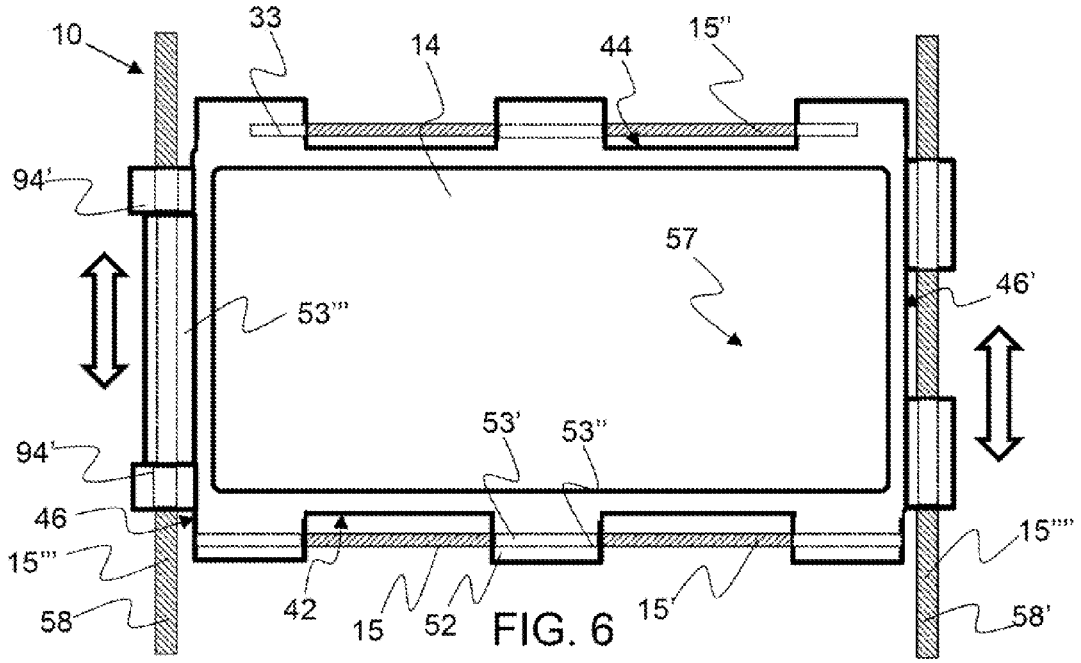

FIG. 6 shows a top-down view of an exemplary cooler body having body bars configured on all four sides of the cooler body.

Figure 7:
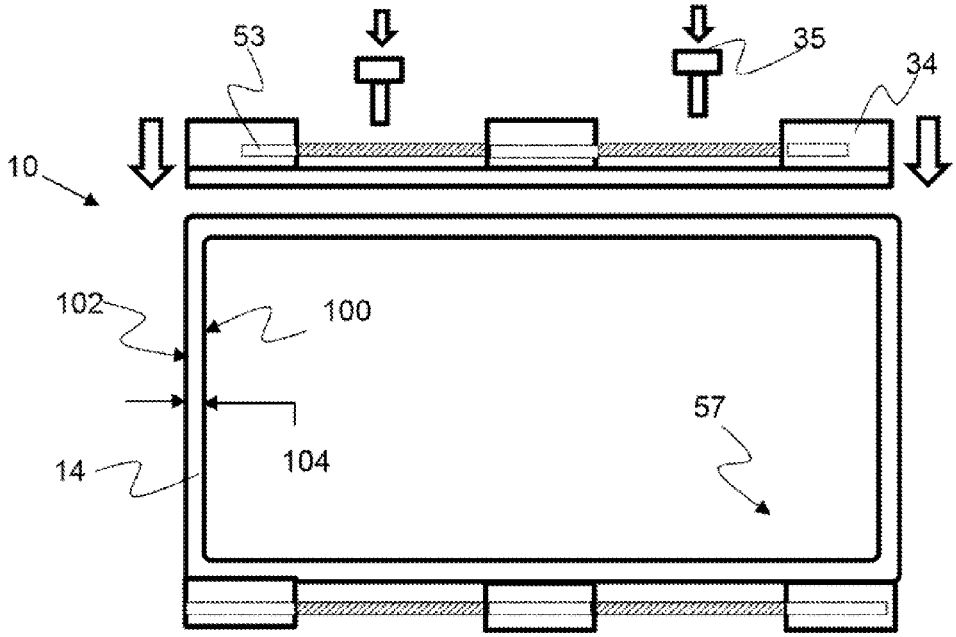

FIG. 7 shows a top-down view of an exemplary cooler body having body bars configured on the front and back walls of the cooler body, wherein the back bar supports are detachably attachable.

Figure 8:
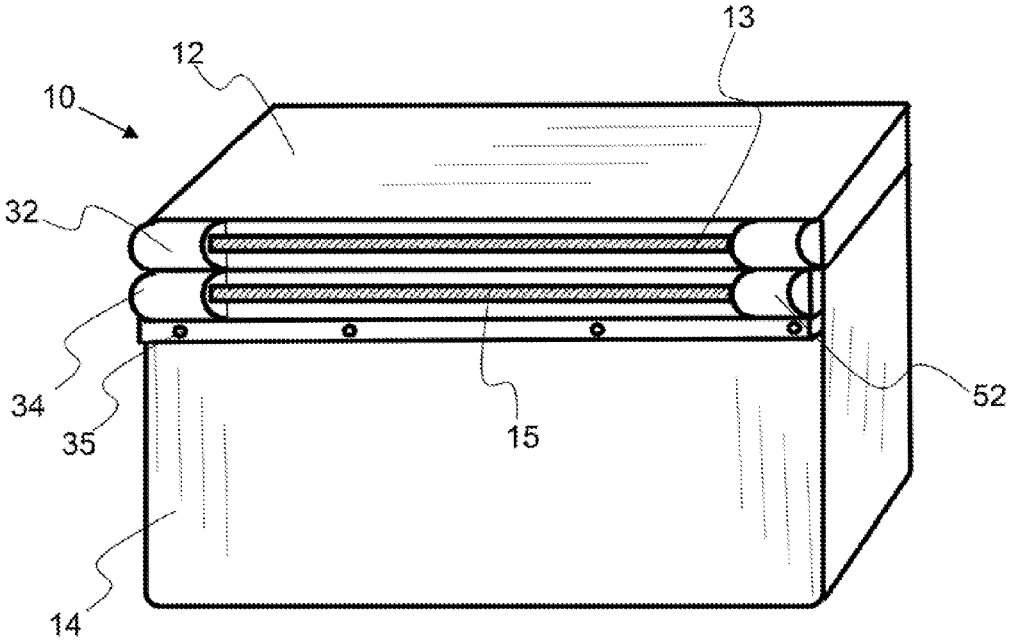

FIG. 8 shows a front isometric view of an exemplary cooler having a detachable body bar and body bar support.

Figure 9:
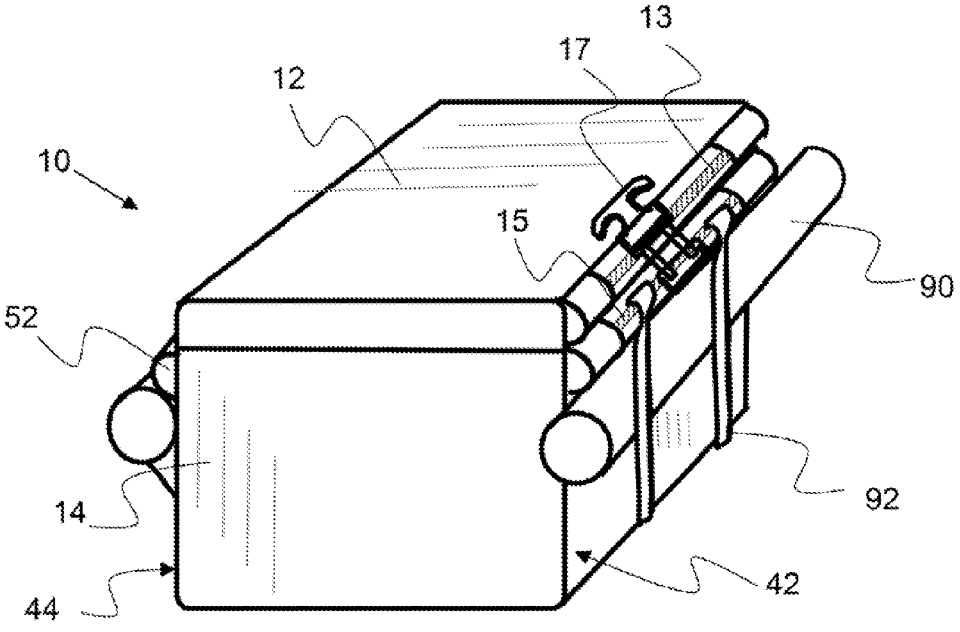

FIG. 9 shows a side isometric view of an exemplary cooler strapped to an object and having a front lid and body bar with a latch configured thereon.

Figure 10:
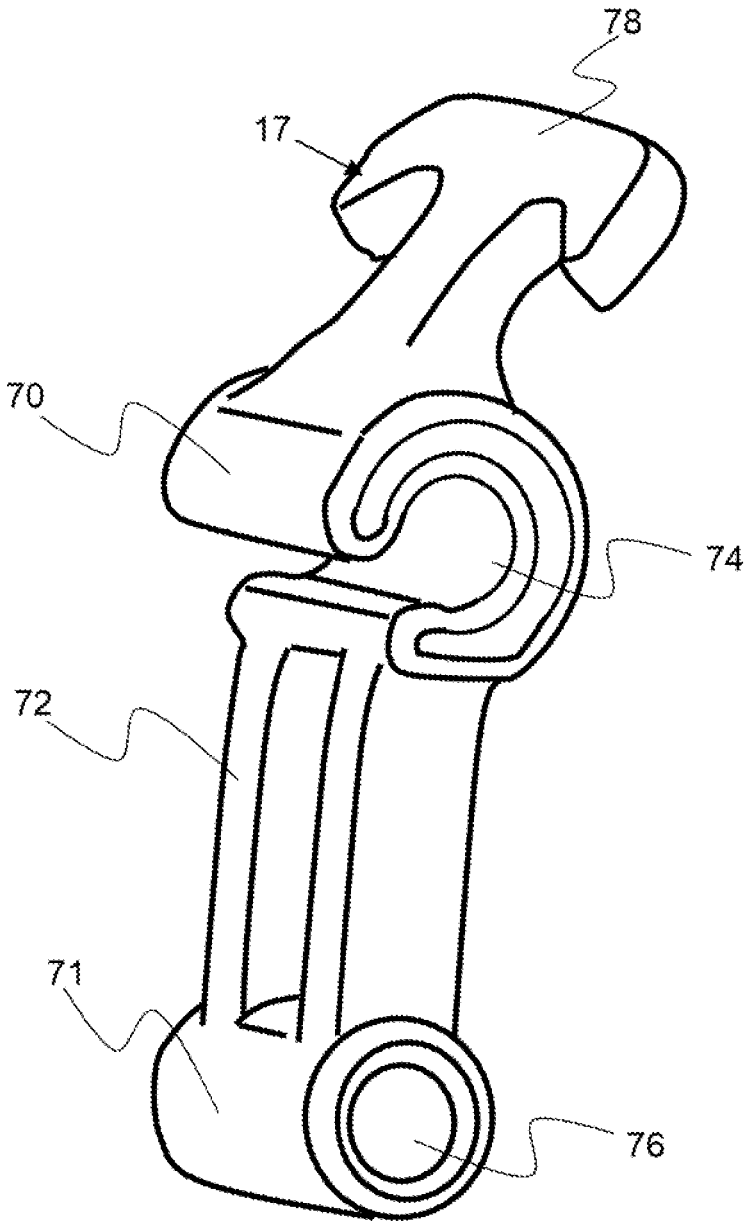

FIG. 10 shows a side isometric view of an exemplary latch having a first opening, a second opening and a clamp.

Figure 11:
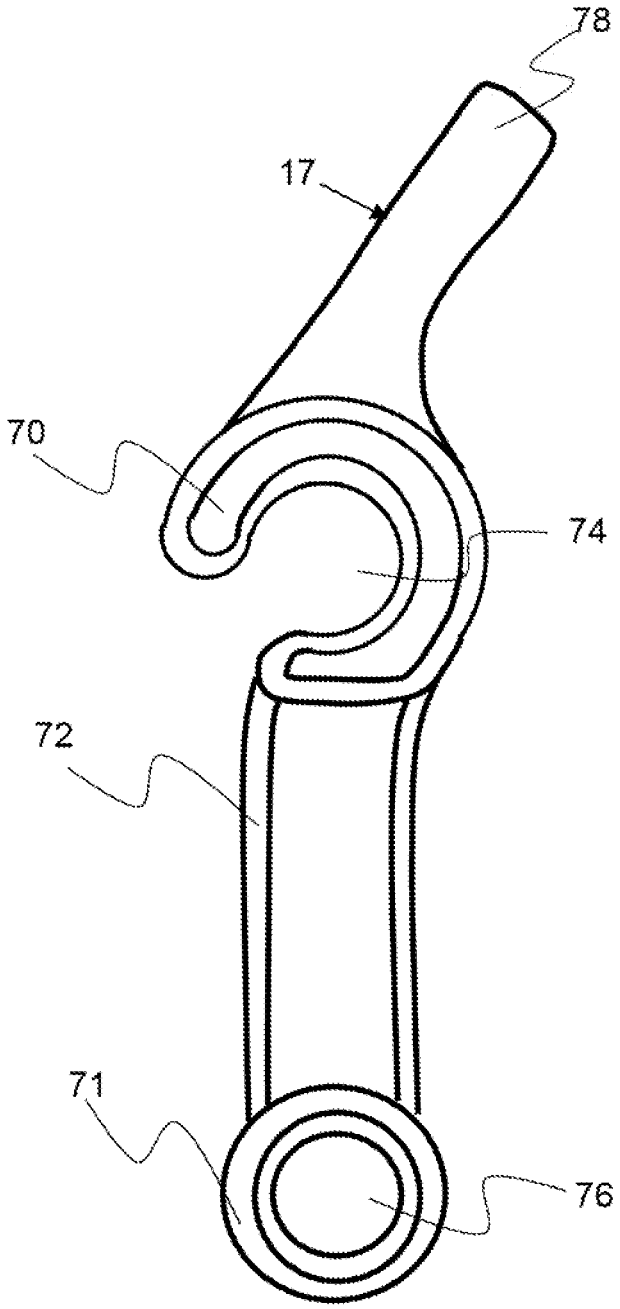

FIG. 11 shows a side view of the exemplary latch shown in FIG. 10.

Figure 12:
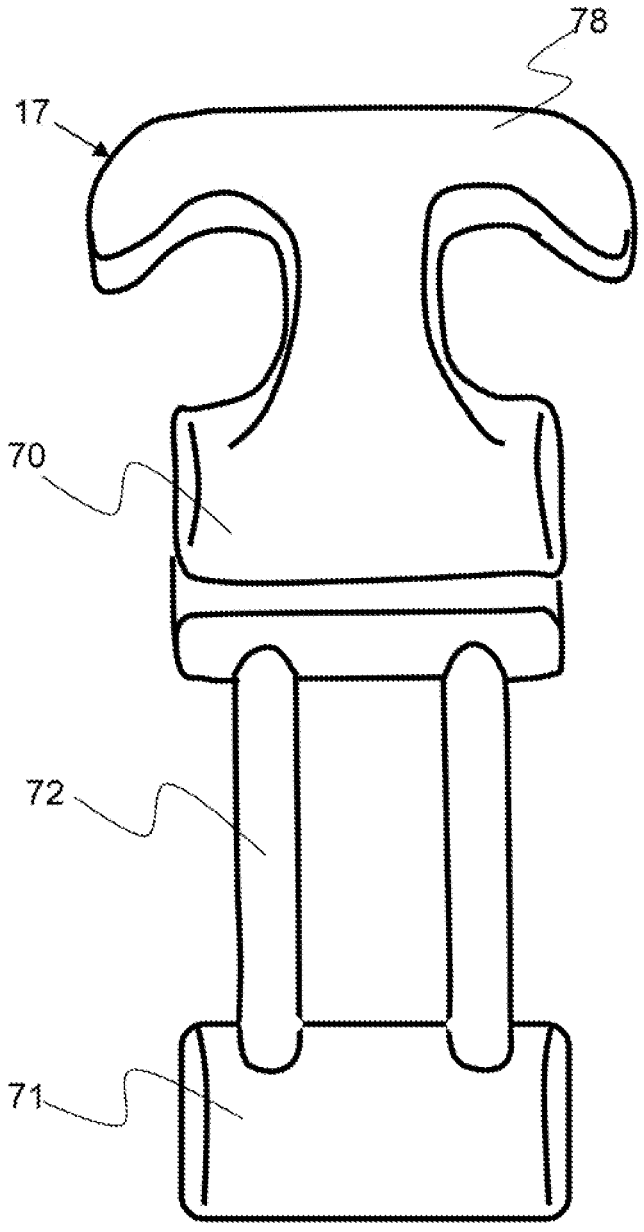

FIG. 12 shows a front view of the exemplary latch shown in FIG. 10.

Figure 13:
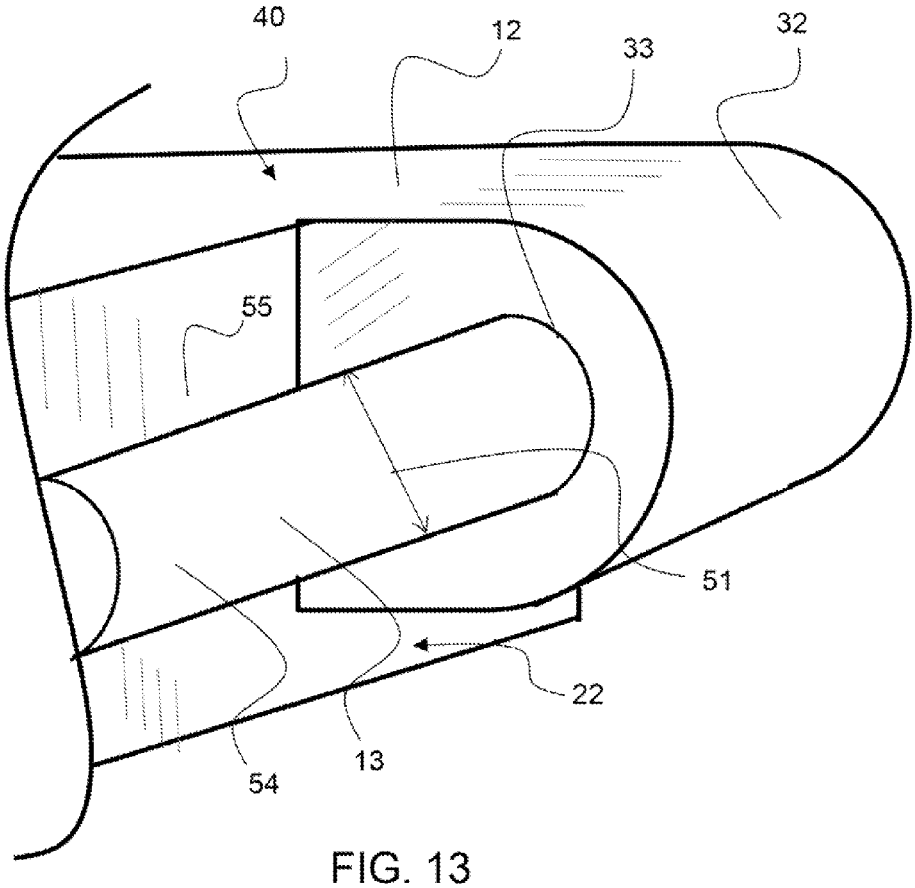

FIG. 13 shows a front isometric expanded view of a lid bar configured in a lid support conduit.

Figure 14:
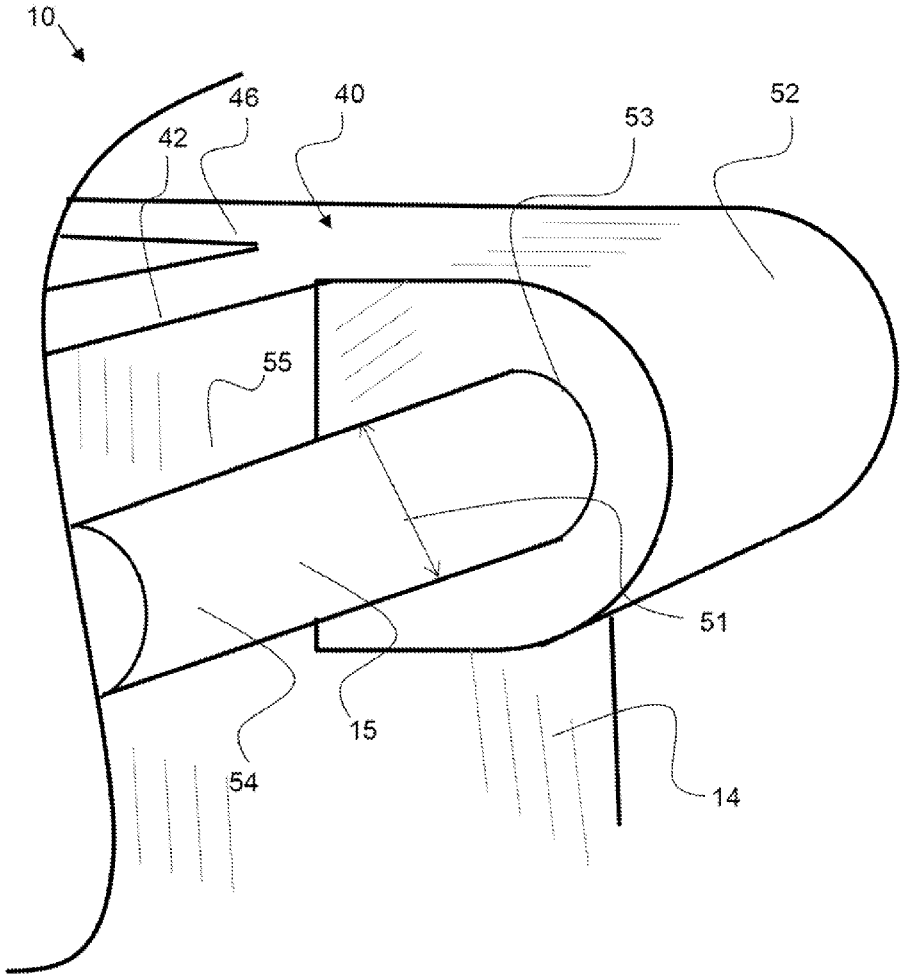

FIG. 14 shows a front isometric expanded view of a body bar configured in a body support conduit.

Figure 15:
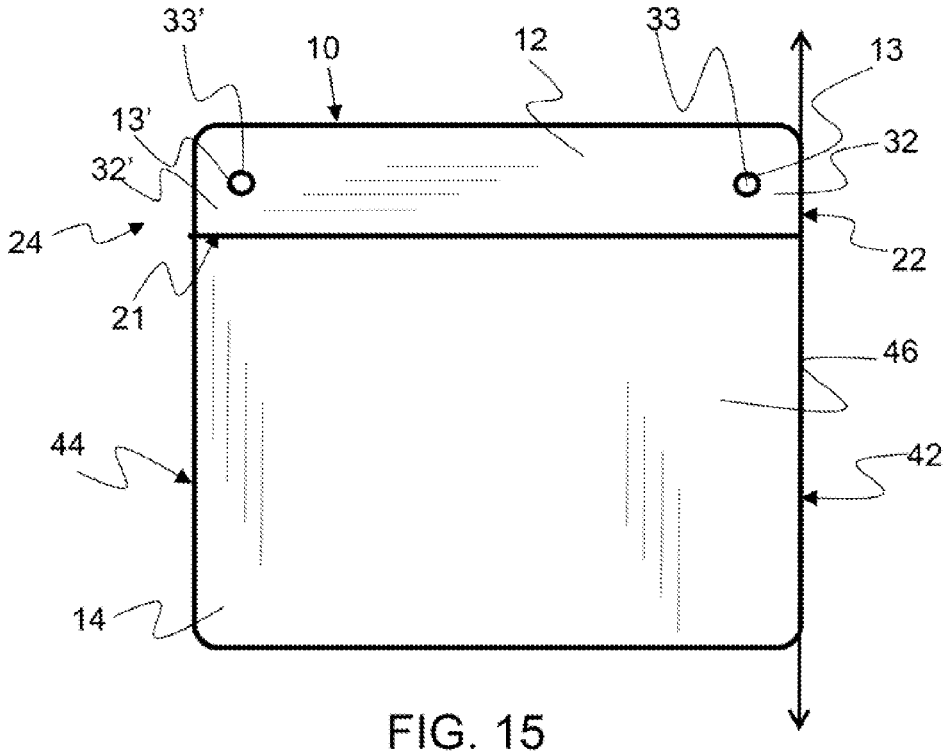

FIG. 15 shows a side view of an exemplary cooler having a recessed lid bar on both the front and backsides.

Figure 16:
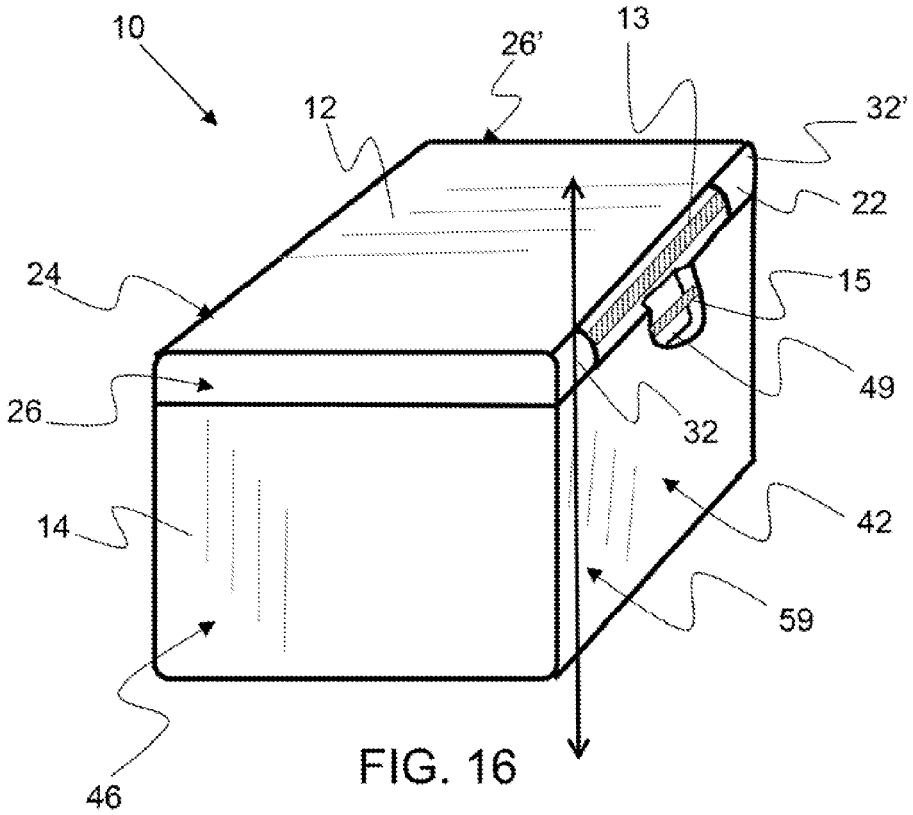

FIG. 16 shows a side isometric view of an exemplary cooler having a recessed lid bar configured between two integral lid supports.

Figure 17:
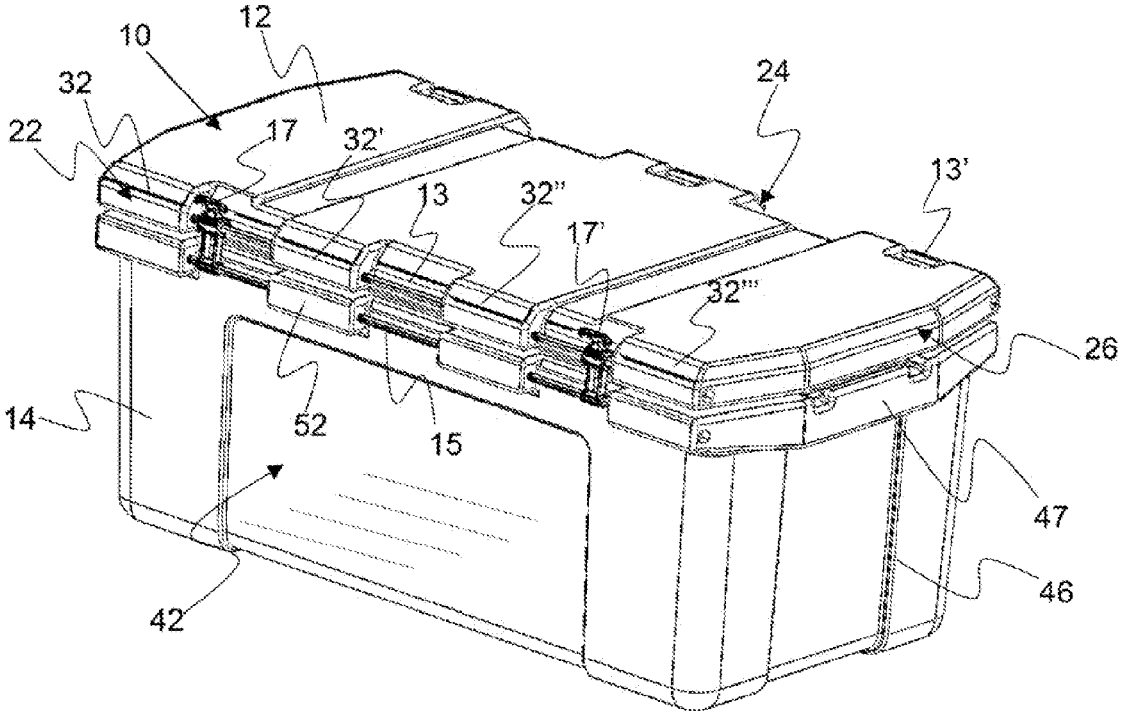
Figure 18:
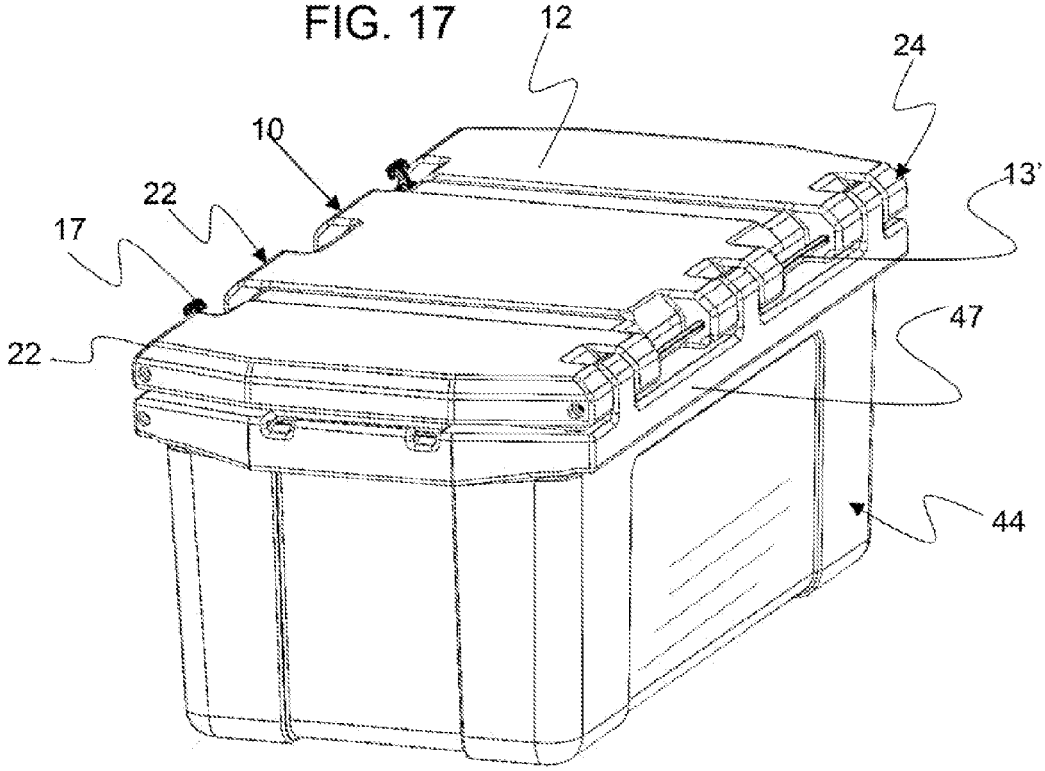

FIG. 17 shows a front/side perspective view of an exemplary cooler having a lid bar configured on the front and back of the lid and a body bar configured on the front of the body FIG. 18 shows a back/side perspective view of the exemplary cooler shown in FIG. 17.

Figure 19:
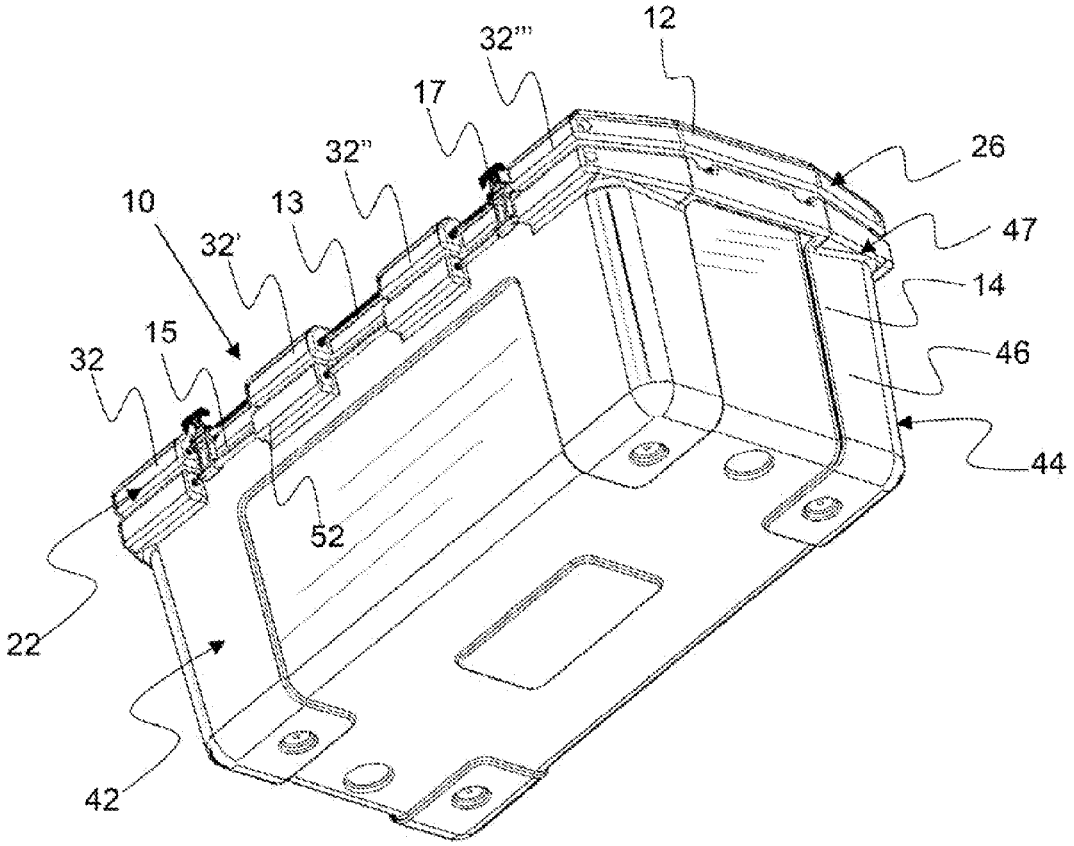

FIG. 19 shows a bottom/front perspective view of the exemplary cooler shown in FIG. 17.

Figure 20:
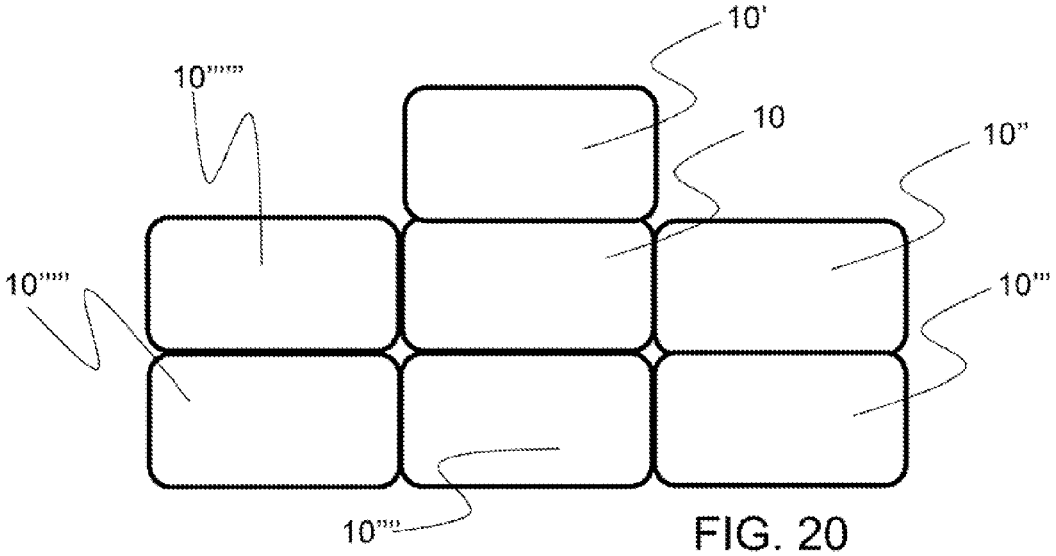

FIG. 20 shows a top-down view of a plurality of coolers having a "flush pack geometry" and being abutted next to each other.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1A, an exemplary cooler 10 has a lid bar 13 configured between two lid supports 32, 32' on the front side 22 of the cooler lid 12. In this embodiment, the cooler lid comprises a lid bar only on the front side and not on the back side 24, or lid sides 26, 26'. The cooler body 14 comprises a body bar 15 retained in a recess 49 of the front wall 42 of the cooler body exterior 59. A latch, as shown in FIGS. 11-12, may be attached to the lid and body bar and clamped down to secure the cooler lid to the cooler body.

As shown in FIG. 1B, the cooler 10 shown in FIG. 1A has a body bar 15 in a body wall recess 49. This configuration provides a cooler body without any protruding surfaces, whereby the cooler can be secured to, or inserted between, objects with planar surfaces. The cooler lid may comprise a lid bar 13 and lid supports 32 that do not extend past the exterior front wall 42 of the cooler body 14. The height of the cooler 25, including the cooler lid, is shown in FIG. 1B.

As shown in FIG. 1C, the cooler 10 shown in FIG. 1A has a lid bar 13 configured on the front side 22 of the lid 12. The lid support conduit 33 is a through conduit whereby the conduit is an opening in the lid support that extends through the lid support. A hinge 29 is shown coupling the cooler lid 12 to the cooler body 14 on the backside of the cooler, or between the back side 24 of the cooler lid and the back wall 44 of the cooler body. A hinge may be any suitable type of hinge and may be configured in any suitable location. It is to be understood that the cooler, as described herein, does not have to have a hinge and can comprise a cooler lid that is completely detachable from the cooler body and may be retained by latches and/or straps, as required.

As shown in FIG. 1D, the cooler 10 shown in FIG. 1A has a lid bar 13 extending into conduits 33, 33' with in the lid supports 32, 32' respectively. The length of the cooler 10, and cooler lid 28 are shown as well as the width 27 of the cooler. In addition, the extended length 36 of the lid bar between the two lid supports 32 and 32', is shown. The extended length of a lid bar or body bar may be any suitable length including, but not limited to, about 2 inches or more, about 3 inches or more, about 5 inches or more, about 10 inches or more, about 15 inches or more, about 20 inches or more, about 30 inches or more, about 36 inches or more and any range between and including the extended length values provided. The length of the lid bar extends all the way through the lid supports as indicated by the dashed cross hashed lines in the conduits 33, 33'. The lid bar extends substantially the entire length of the cooler lid as shown in FIG. 1D. A lid bar may be a single bar that extends between two or more supports.

As shown in FIG. 2A, an exemplary cooler 10 has lid bars 13, 13' on the front side 22 and back side 24 of the cooler lid 12 respectively. In this embodiment, a strap that extends from the front side lid bar 13, under the cooler body to the back side lid bar 13, may be used to retain the cooler lid to the cooler. Any suitable type of strap may be used including straps having tightening buckles, or ratchets.

As shown in FIG. 2B, the cooler 10 shown in FIG. 2A has three lid supports 32, 32' and 32" for the front lid bar 13 and back lid bar 13'. Any number of lid supports may be configured on any of the cooler lid sides. The extended lengths 36, 36' of the lid bar configured in the supports along the back side 24 of the cooler lid are shown. The extended lengths in this embodiment are substantially equal with equally space lid supports configured along the back side 24 of the cooler lid 12. However the lid supports may be configured in any suitable way providing for non-uniform extended length. Furthermore, a lid support may have any suitable length 37 including, but not limited, to about 1 inch or more, about 3 inches or more, about 6 inches or more, about 10 inches or more, about 18 inches or more, about 24 inches or more about 36 inches or more and any range between and including the support length values provided.

As shown in FIG. 3, an exemplary cooler 10 has integral lid supports on both the front side 22 and back side 24 of the cooler lid 12 and lid bars configured therein. An integral lid support is made as part of the cooler lid, such as by molding, whereby the lid and lid support(s) are made as a one-piece unit. The cooler lid 12 shown in FIG. 3 has two lid bars 13, 13' configured in the lid supports 32 along the front side 22 of the cooler lid. The centrally configured front side lid support 32 has two conduits 33, 33' for receiving the two lid bars 13, 13' respectively. It is to be understood that two bars may be configured into a support having a through conduit as well. On the left side 26 of the cooler lid, a single lid support is configured and a lid bar 13'" is configured therethrough having extended ends 38 protruding from the lid support, and in this case, from the cooler lid perimeter. Extended ends of a lid bar may be used as handles for carrying the cooler or for mounting the cooler to an object, such as a vehicle or rack. On the right side 26 of the cooler lid 12, two lid supports are configured and retain a lid bar 13"" that also has extended ends. Both the lid supports on the left and right side are configured with through conduits whereby a lid bar may be inserted therethrough as indicated by the large double arrows on either side of the cooler lid. Lid supports configured in this manner may allow for insertion of lid bars for carrying the cooler and removal when reaching a desired location. In addition, collars 94, 94', as shown on the left side 26 of the cooler lid, may be used to secure a lid bar in a desired location. Any combination of lid supports and bars may be configured on a cooler lid as described herein.

As shown in FIG. 4, an exemplary cooler 10 has a detachable lid support 34 on the back side 24 of the cooler lid 12. A detachable support may be configured to be attached to a cooler lid with fasteners 35, such as bolts, screws, interference fit recesses in the cooler lid and insertion features, clamps and the like.

As shown in FIG. 5A, an exemplary cooler 10 has a lid bar 13 and a body bar 15 configured along the front of the cooler. The body bar 15 and body bar supports 52, 52' are configured along the top portion of the exterior 59 front wall 42 of the cooler body 14. This arrangement of the lid bar and body bar being aligned with each other, facilitates clamping of the cooler lid to the cooler body.

As shown in FIG. 5B, the cooler 10 shown in FIG. 5A has an exemplary latch 17 configured on the lid bar 13 and body bar 15. Any suitable latch may be used to couple and retain the lid bar to the body bar. An exemplary latch is shown in FIG. 10-12 having a lid coupling portion and body coupling portion.

As shown in FIG. 6, an exemplary cooler 10 has integral body supports on both the front side 42 and back side 44 of the cooler body 14 and body bars configured therein. An integral body support is made as part of the cooler body, such as by molding, whereby the body and body support(s) are made as a one-piece unit. The cooler body 14 shown in FIG. 6 has two body bars 15, 15' configured in the body supports 52 along the front wall 42. The centrally configured front wall body support 32 has two conduits 53, 53' for receiving the two body bars 15, 15' respectively. On the left wall 46 of the cooler body, a single body support is configured and a body bar 15' is configured therethrough having extended ends 58 protruding from the body support, and in this case from the cooler body perimeter. Extended ends of a body bar may be used as handles for carrying the cooler or for mounting the cooler to an object, such as a vehicle or rack. On the right wall 46 of the cooler body 14, two body supports are configured and are retaining a body bar 15"" that also has extended ends. Both the body supports on the left and right walls are configured with through conduits whereby a body bar may be inserted therethrough as indicated by the large double arrows on either side of the cooler body. Body supports configured in this manner may allow for insertion of body bars for carrying the cooler and removal when reaching a desired location. In addition, collars 94, 94', as shown on the left wall 46 of the cooler body may be used to secure a body bar in a desired location. Any combination of body supports and bars may be configured on a cooler body as described herein.

As shown in FIG. 7, an exemplary cooler body 14 has body bars configured on the exterior front and back walls of the cooler body, wherein the back bar supports are detachably attachable. A detachable support 34 provides a user versatility in the configuration of supports and bars for both the cooler lid and cooler body. A cooler lid or body may comprise threaded recesses for receiving a fastener 35. The interior 57 of the cooler is also shown in FIG. 7, wherein a cavity, having a volume, is defined by the inside area of the front, back, side walls and the bottom. The inside surface of the cooler wall 14 has an inside surface 100, an outside surface 102 and a thickness therebetween. As described herein, the space between the interior and exterior surfaces of a cooler wall or lid may comprise a hollow space or porosity. For example, a plastic material may comprise porosity within the interior of the cooler wall or lid.

As shown in FIG. 8, an exemplary cooler 10 has a detachable support 34 comprising a body bar 15 and body bar supports 52. Fasteners 35 are shown attaching the detachable support to the cooler body 14.

As shown in FIG. 9, an exemplary cooler 10 is strapped to an object 90 and has a front side lid bar 13 and body bar 15 with a latch 17 configured thereon. Straps 92 are configured around the body bar on either side of the clamp 17 and extend down along the front wall 42 of the cooler body, around an object 90, under the bottom 41 of the cooler body, up along the back wall 44, and to a body bar (not shown) extending between body supports 52 configured along the top of the back wall of the cooler body. The cooler, as shown in this embodiment, is positively restrained to the object in that the straps are configured around at least one bar and the cooler cannot slide out from the straps. It is to be appreciated that the interior of the cooler 10, as shown in FIG. 9, can still be accessed simply by opening the latch. This combination of positive retention and easy access provides a unique combination of useful benefits.

As shown in FIG. 10, an exemplary latch 17 has a lid coupling portion 70 having a first opening 74, a body coupling portion 71 having a second opening 76, and a clamp 78. A connector portion 72 connects the lid coupling portion to the body coupling portion. The lid coupling portion opening, or first opening, allows for a bar to be pressed into the opening, whereas the body portion opening, or second opening 76, is a through hole that requires a bar to be slid therethrough. A body coupling portion may also comprise an opening as depicted on the lid coupling portion, thereby allowing the latch to be easily detachable from a cooler.

As shown in FIG. 11, the exemplary latch 17 shown in FIG. 10 has a first opening 74, a second opening 76 and a clamp 78. The clamp is configured to secure the first opening around a bar.

FIG. 12, shows a front view of an exemplary latch having a clamp 78.

As shown in FIG. 13, an exemplary lid bar 13 is configured in a lid support 32 conduit 33. The lid bar has a diameter 51 and an open space 55 around the perimeter 54 of the bar. The open space 55 extends around the perimeter and between the lid bar 13 and the front side 22 of the cooler lid. This open space allows for a retaining device, such as a strap or rope, to extend between the lid bar and the cooler lid. The distance between the lid bar and a side, such as the front side 22 of the cooler lid may be any suitable value including about 0.25 inches or more, about 0.5 inches or more, about 0.75 inches or more, about 1.0 inches or more, about 2.0 inches or more and any range between and including the values provided.

As shown in FIG. 14, an exemplary body bar 15 is configured in a body support 52 conduit 53. The body bar has a diameter 51 and an open space 55 around the perimeter 54 of the bar. The open space 55 extends around the perimeter and between the body bar 15 and the front 42 of the cooler body 14. This open space allows for a retaining device, such as a strap or rope, to extend between the body bar 15 and the cooler body 14. The distance between the body bar and a wall, such as the front wall 42, of the cooler body may be any suitable value including about 0.25 inches or more, about 0.5 inches or more, about 0.75 inches or more, about 1.0 inches or more, about 2.0 inches or more and any range between and including the values provided.

As shown in FIG. 15, a cooler 10 comprises an integral and recessed lid bar 32 and 32' on both the front side 22 and backside 24. The plane of the front side 22 is indicated by the double arrowed line extending vertically along the front side. The lid bar 13 is recessed from this plane. This configuration allows for better packing of coolers and may prevent damage to a lid and/or body support that extends out from the plane of the cooler. The exemplary cooler shown in FIG. 15 has a "flush pack geometry", wherein there are no extensions from the plane of the surfaces around the perimeter whereby a plurality of coolers having this flush pack geometry may be abutted with substantially no between cooler surfaces.

As shown in FIG. 16, an exemplary cooler 10 has a recessed lid bar 13 configured between two integral lid supports. An integral and recessed body bar is also shown along the front face 42 of the cooler body 14. The front plane of the cooler body 13 is indicated by the double arrowed vertical arrow. A latch may be configured between the lid bar 13 and body bar 14 and also be recessed and not extend beyond the front plane of the cooler body. This configuration may be designed on any number of sides of the cooler. The exemplary cooler shown in FIG. 15 and FIG. 16 has a substantially rectangular shape having no extensions from the lid sides or body walls. It is to be understood that an exemplary cooler may have a substantially rectangular, square or cube shape having sufficient no extensions from the lid or body, whereby a polarity of coolers having this shape may be configured next to each other with substantially or gap there between. For example, coolers having this exemplary no extension geometry may be configured with the front wall of a first cooler butted to the back wall of a second cooler wherein there is substantially no space or gap between the abutted cooler wall surfaces. Substantially no space or gap between abutted coolers, as used herein, means less than 0.125 inches. The exemplary cooler shown in FIG. 16 has a flush pack geometry wherein a plurality of coolers with this geometry may be pack next to each other such that the surfaces are flush with one another having substantially no gaps there between As shown in 17, an exemplary cooler 10 has a lid bar 13 and 13' configured on the front side 22 and back side 24 of the lid 12 respectively, and a body bar 15 configured on the front wall 42 of the cooler body 14. The body and lid bar are part of an extension 47 that extends out from the perimeter of the cooler body 14. The lid and body bar are continuous bars in this embodiment and are supported by for supports along the front of the cooler. The lid supports 32, 32''' are aligned with the body supports 52 along the front side of the cooler thereby providing exposed lengths of the lid and body bars that are aligned or adjacent each other. Two latches 17, 17' are attached to the lid bar and the body bar on the front side of the cooler As shown in FIG. 18, the exemplary cooler has a lid bar 13 prime that extends along the back side 24 of the cooler lid 12.

As shown in FIG. 19 the exemplary cooler 10 has a lid bar 13 extending along the front side of the lid. Four discrete lid supports 32, 32''' are configured along the front side of the lid to retain the lid bar. The lid and the body have an extension 47 that extends out from the surface of the cooler body 14. The extension 47 is comprised of the body supports 52 comprise along the front wall 42 of the cooler. Body supports and/or lid supports may extend out from the perimeter of the cooler body to create an extension on any side or in an exemplary embodiment along all sides. This extension may be used to retain the cooler in a frame as shown in FIG. 9.

As shown in FIG. 20, the plurality of exemplary coolers 10-10''''' have a flush pack geometry and are configured next to each other with substantially no gap between the sides of the abutted coolers. The side surfaces of the abutted coolers are flush with one another. Cooler 10 has coolers abutted to all sides including the front, back left and right sides. A flush pack geometry cooler may provide for tighter and better packing of a plurality of coolers. This may be particularly advantageous when trying to pack coolers in a limited amount of space and/or when the packed plurality of coolers may be subjected to vibration and/or movement. For example, when a plurality of coolers are packed on a raft there is a limited amount of space, and the packed coolers are subjected to lots of motion as a raft moved through rapids.

DEFINITIONS

Conduit, as used herein, is an opening or recess in a lid or body support that is configured for the insertion of a bar. A conduit may only partially extend into a support or be a through conduit, wherein the conduit extends all the way through the support whereby the bar may extend from one side of the support to the other.

Positively restrained, as used herein, means that a retaining device, such as a strap or rope, may be configured around at least one bar, lid or body bar, of the cooler described herein, whereby the cooler cannot be decoupled from the retaining device by sliding or otherwise moving.

Discrete lid supports, as used herein, means that the lid supports are spaced apart from each other to create a space for an extended length of a lid bar there between.

Discrete body supports, as used herein, means that the body supports are spaced apart from each other to create a space for an extended length of a body bar there between.

A recessed lid bar or body bar, as used herein, is configured within the lid or body portion and does not extend out beyond the plane of the lid or body.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A cooler comprising:

a. a lid comprising:

i. a front side having a length;

ii. a back side, iii. a left side;

iv. a right side; and v. two lid bars configured on opposing sides of said lid and extending between a plurality of integral and discrete lid supports:

wherein the two lid bars have extended lengths between said plurality of discrete lid supports and an open space around a perimeter of each of the two lid bars, along said extended length.

2. The cooler of claim 1, wherein the lid bars are integral lid bars.

3. The cooler of claim 2, wherein the two integral lid bars are a one-piece unit with the lid.

4. The cooler of claim 1, whereby the lid and the plurality of integral and discrete lid supports are a one-piece unit.

5. The cooler of claim 1, wherein the lid bar is detachably attachable to the lid, whereby the lid bar is configured to be slid through conduits in the lid supports.

6. The cooler of claim 1, wherein a first of the two lid bars is configured on the front side of the lid and a second of the two lid bars is configured on the back side of the lid.

7. The cooler of claim 6, further comprising a third lid bar and a fourth lid bar configured on the left and right sides of the lid, respectively, and retained by the plurality of integral and discrete lid supports.

8. The cooler of claim 1, wherein the extended lengths of the two lid bars are 3 inches or more.

9. The cooler of claim 1, wherein the two lid bars are recessed lid bars.

10. The cooler of claim 1, further comprising:

a. a body comprising:

i. a bottom;

ii. a front wall having a length;

iii. a back wall;

iv. a left and a right side wall disposed between and connecting said front wall and back wall to form a cavity having an interior and an exterior;

v. a body bar configured on the exterior of one of said body walls and substantially at the top of said body wall and extending between a plurality of integral and discrete body supports;

wherein said body bar has an extend length between said plurality of integral and discrete body supports and an open space around a perimeter of said body bar along said extended length.

11. The cooler of claim 10, wherein the body bar is an integral body bar.

12. The cooler of claim 11, wherein the integral body bar and is a one-piece unit with said body.

13. The cooler of claim 10, wherein the body bar is a single bar and whereby the body bar extends substantially the entire length of the front wall.

14. The cooler of claim 10, wherein the cooler comprises at least one detachable body support.

15. The cooler of claim 10, wherein the plurality of integral body supports comprise conduits, whereby the body bar is configured to be slid through said conduits in the body supports.

16. The cooler of claim 10, wherein the body bar is an integral body bar configured on the front wall of the body.

17. The cooler of claim 10, further comprising a body bar integrally configured on the exterior of both side walls, substantially at the top of the body and retained by the plurality of integral and discrete body supports.

18. The cooler of claim 10, wherein the extended length of the body bar is 3 inches or more and the body bar is circular in cross-sectional shape and has an outer diameter of at least 0.5 inches.

19. The cooler of claim 10, wherein the body bar is an integral and recessed bar.

20. A cooler comprising:

a. a lid comprising:

i. a front side having a length;

ii. a back side, iii. a left side;

iv. a right side; and v. two lid bars configured on opposing sides of said lid and extending between a plurality of integral and discrete lid supports;

wherein the two lid bars have extended lengths between said plurality of discrete lid supports and an open space, around a perimeter of each of the two lid bars, along said extended length;

b. a body comprising:

i. a bottom;

ii. a front wall having a length;

iii. a back wall;

iv. a left and a right side wall disposed between and connecting said front wall and back wall to form a cavity having an interior and an exterior;

v. a body bar configured on the exterior of one of said body walls and substantially at the top of said body wall and extending between a plurality of integral and discrete body supports;

c. wherein said body bar has an extend length between said plurality of integral and discrete body supports and an open space around a perimeter of said body bar along said extended length, wherein said lid bar and said body bar are configured on a same side of the cooler.

21. The cooler of claim 20, further comprising a latch comprising:

a. a lid coupling portion comprising a first opening for receiving the lid bar;

b. a body coupling portion comprising a second opening for receiving the body bar;

c. a clamp configured to actuate from an open position, to a closed position:

whereby when said latch is configured on said lid bar and said body bar and the clamp is actuated from an open position to a closed position, the first opening is secured around said lid bar.

22. The cooler of claim 21, wherein at least one of the first opening or second openings is a conduit.

23. The cooler of claim 20, wherein the cooler has a flush pack geometry whereby said cooler may be abutted to a second cooler having a flush pack geometry with the front wall of said cooler against with the back wall of said second cooler wherein there are substantially no gaps between said cooler and said second cooler.

* * * * *